US010021905B1

(12) United States Patent
Bebee

(10) Patent No.: US 10,021,905 B1
(45) Date of Patent: Jul. 17, 2018

(54) SMOKING APPARATUS WITH A PUMP AND A METHOD OF USING SAME

(71) Applicant: Jeffrey Lloyd Bebee, Peterborough (CA)

(72) Inventor: Jeffrey Lloyd Bebee, Peterborough (CA)

(73) Assignee: Modern Vital Inc. (CA)

( * ) Notice: Subject to any disclaimer, the term of this patent is extended or adjusted under 35 U.S.C. 154(b) by 0 days.

(21) Appl. No.: 15/408,140

(22) Filed: Jan. 17, 2017

(51) Int. Cl.

| | |
|---|---|
| ***A24F 11/00*** | (2006.01) |
| ***A24F 1/08*** | (2006.01) |
| ***A24F 1/32*** | (2006.01) |
| ***F04B 33/00*** | (2006.01) |
| ***F04B 39/12*** | (2006.01) |
| ***F04B 53/10*** | (2006.01) |

(52) U.S. Cl.
CPC ..... *A24F 1/08* (2013.01); *A24F 1/32* (2013.01); *F04B 33/00* (2013.01); *F04B 39/12* (2013.01); *F04B 53/10* (2013.01)

(58) Field of Classification Search
CPC ..... A24F 47/008; A24F 47/002; A24F 1/30; A24F 13/04; A24D 3/043
USPC ..... 131/328, 173, 198.2, 329
See application file for complete search history.

(56) References Cited

U.S. PATENT DOCUMENTS

| | | | | |
|---|---|---|---|---|
| 2,324,359 | A * | 7/1943 | Callan | A63H 33/28 392/395 |
| 2,612,173 | A * | 9/1952 | Gustafson | A24F 1/22 131/184.3 |
| 4,253,475 | A * | 3/1981 | Schreiber | A24F 1/30 131/173 |
| 4,788,988 | A * | 12/1988 | Titus | A24F 1/30 131/173 |
| 7,735,494 | B2 * | 6/2010 | Bollinger | A24F 13/00 131/273 |
| 2017/0135398 | A1 * | 5/2017 | Scott | A24F 47/004 |
| 2017/0208825 | A1 * | 7/2017 | Backus | A23B 4/0523 |
| 2017/0251718 | A1 * | 9/2017 | Armoush | A24F 1/30 |

* cited by examiner

*Primary Examiner* — Hae Moon Hyeon
(74) *Attorney, Agent, or Firm* — Daniel R. Polonenko

(57) ABSTRACT

A smoking apparatus has a vessel, a smoke generation structure coupled to a lower portion of the vessel for accommodating smoke-generation substance for generating smoke, and for guiding the smoke into the vessel, a smoke guide for discharging the smoke out of the vessel, and a pump for pumping the smoke from the smoking generation structure into the vessel and for pumping the smoke out of the vessel through the smoke guide.

20 Claims, 15 Drawing Sheets

SMOKING APPARATUS WITH A PUMP AND A METHOD OF USING SAME

FIELD OF THE DISCLOSURE

The present invention relates generally to a smoking apparatus, and in particular to a smoking pipe, and a method of using same.

BACKGROUND

Smoking devices are known. For example, a bong or waterpipe has a long history of use as a filtration device for smoking herbal substances such as *cannabis*, tobacco, and the like.

For example, FIG. 1 shows a typical, prior-art waterpipe 10. As shown, the waterpipe 10 comprises a fluid-tight vessel 12 coupled, at an upper portion thereof, to a flexible tubing 14 having a mouthpiece 16. The waterpipe 10 also comprises a tubing 20, known as a stem, which extends into the vessel 12 through a sidewall thereof and terminates at a lower, proximal end 24 located in a lower portion of the vessel 12. A bowl 18 is coupled to the stem at an upper, distal end 22 outside the vessel 12, for accommodating herbal substance 28.

In use, the vessel 12 is filled with sufficient water 26 such that the proximal end 24 of the stem 20 is under the surface of the water 26. A suitable amount of herbal substance 28 is loaded into the bowl 18, and is lit or otherwise heated for generating smoke. A user (not shown) may suck the mouthpiece 16 to draw air therefrom and create a negative pressure (compared to the atmosphere pressure) in the vessel 12. As a result, smoke 30 is drawn through the stem 20 into the water 26, forming bubbles 32 therein. While flowing though the water, the smoke bubbles 32 are filtered and cooled by the water 26. After escaping from the water at the water surface, the filtered and cooled smoke 34 moves through the vessel 12 and the flexible tubing 14, and is discharged from the mouthpiece 16 into the user's mouth.

Other waterpipes are also known in the art, with various shapes, materials, colors and/or additional components for improving the usability of the waterpipes. Nevertheless, it is always a desire to provide a novel smoking apparatus such as a novel waterpipe, and a method of using same.

SUMMARY

According to one aspect of this disclosure, there is provided a smoking apparatus. The smoking apparatus comprises: a vessel; a smoke generation structure coupled to a lower portion of the vessel for accommodating smoke-generation substance for generating smoke, and for guiding the smoke into the vessel; a smoke guide for discharging the smoke out of the vessel; and a pump for pumping the smoke from the smoking generation structure into the vessel and for pumping the smoke out of the vessel through the smoke guide.

In some embodiments, the pump is a manually operable pump.

In some embodiments, the pump comprises a volume-changeable chamber, an inlet valve in fluid communication with the chamber and the smoke generation structure, and an outlet valve in fluid communication with the chamber and the smoke guide.

In some embodiments, the apparatus further comprises a slidable sleeve sealably coupled to the smoking guide at a first end thereof, and wherein at least a portion of the vessel is sealably and slidably received in the sleeve, with the slidable sleeve and the vessel together forming the volume-changeable chamber of the pump.

In some embodiments, the apparatus further comprises a hollow mandrel having a longitudinal bore, the mandrel sealably coupled to the smoking guide at one end thereof, and wherein the vessel comprises a cylindrical upper portion sealably and slidably receiving the mandrel, the mandrel and the vessel forming the volume-changeable chamber of the pump.

In some embodiments, the smoke generation structure comprises a recess for accommodating the smoke-generation substance.

In some embodiments, the smoke generation structure comprises the inlet valve, and wherein the inlet valve is a pressure actuated one-way valve only allowing fluid communication from the recess to the vessel.

In some embodiments, the inlet valve comprises one or more flexible pieces forming one or more slits, the slits openable under a positive pressure applied to the one or more flexible pieces from an inflow direction, and closable under a positive pressure applied to the one or more flexible pieces from a backflow direction opposite to the inflow direction.

In some embodiments, the sleeve comprises the outlet valve, and wherein the outlet valve is a one-way valve only allowing the smoke being discharged from the vessel via the smoke guide.

In some embodiments, the sleeve comprises a first wall at the first end thereof, and wherein the first wall comprises a first opening sealably receiving a first end of the smoke guide, and a second opening removably receiving a second end of the smoke guide, the first wall of the sleeve and the smoke guide forming the outlet valve.

In some embodiments, the smoke guide comprises the outlet valve, and wherein the outlet valve is a pressure actuated one-way valve only allowing the smoke being discharged from the vessel via the smoke guide.

According to another aspect of this disclosure, there is provided a smoking method. The smoking method comprises: filling water in a lower portion of a vessel; generating smoke from smoke-generation substance and guiding the generated smoke into the water via a smoke generation structure; pumping, by a pump, the smoke from the smoke generation structure into the vessel; and pumping, by the pump, the smoke accumulated in the vessel out of the vessel through a smoke outlet.

In some embodiments, the pump comprises a volume-changeable chamber, a pressure actuated inlet valve in fluid communication with the chamber and the smoke generation structure, and an outlet valve in fluid communication with the chamber and the smoke outlet; and said pumping the smoke from the smoke generation structure into the vessel comprises: closing the outlet valve; and increasing the volume of the chamber for opening the inlet valve and drawing the smoke into the vessel.

In some embodiments, said pumping the smoke accumulated in the vessel out of the vessel through the smoke outlet comprises: opening the outlet valve; and reducing the volume of the chamber for closing the inlet valve and discharging the smoke out of the vessel through the smoke outlet.

In some embodiments, the chamber comprises the vessel, and a sleeve sealably and slidably receiving at least a portion of the vessel; and said increasing the volume of the chamber for drawing the smoke into the vessel comprises: sliding the sleeve along a first direction to increase the volume of the chamber for drawing the smoke into the vessel.

In some embodiments, said reducing the volume of the chamber for discharging the smoke out of the vessel through the smoke outlet comprises: sliding the sleeve along a second direction opposite to the first direction to reduce the volume of the chamber for discharging the smoke out of the vessel through the smoke outlet.

In some embodiments, the smoke outlet is a smoke guide, the sleeve comprises a first wall at the first end thereof, the first wall comprises a first opening sealably receiving a first end of the smoke guide, and a second opening removably and sealably receiving a second end of the smoke guide, and said closing the outlet valve comprises: inserting the second end of the smoke guide into the second opening.

In some embodiments, said opening the outlet valve comprises: removing the second end of the smoke guide from the second opening.

In some embodiments, the outlet valve is a pressure actuated way valve, said sliding the sleeve along the first direction to increase the volume of the chamber also closes the outlet valve, and said sliding the sleeve along the second direction to reduce the volume of the chamber also opens the outlet valve.

In some embodiments, the method further comprises: filling ice in the lower portion of the vessel.

In some embodiments, said filling water in the lower portion of the vessel comprises: filling ice in the lower portion of the vessel, the ice meltable into water by the smoke pumped into the vessel.

DETAILED DESCRIPTION

In the following, a smoking apparatus in various embodiments is described. In one embodiment, the smoking apparatus is generally made of glass with some sealable components made of silicone. Correspondingly, some of the figures show the smoking apparatus and/or its various glass components as transparent. However, in some other figures, glass components of the smoking apparatus may be shown without transparency, for ease of illustration. Moreover, the components shown in the figures may not be up to scale.

Figure 1:
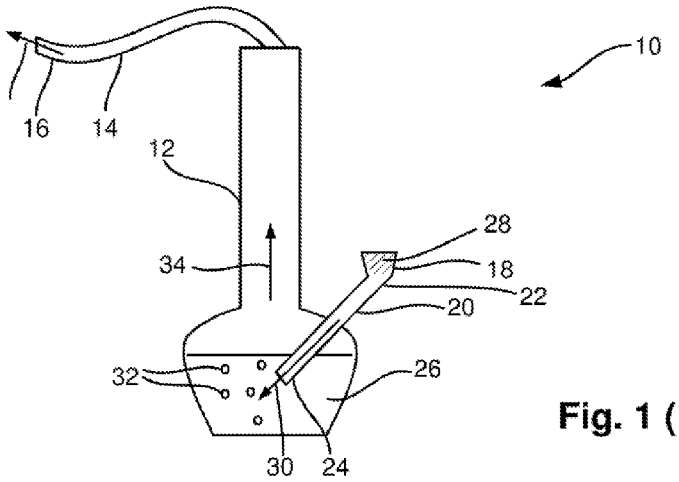
Fig. 1 (Prior art)
FIG. 1 is a schematic cross-sectional view of a prior-art waterpipe.
Figure 2A:
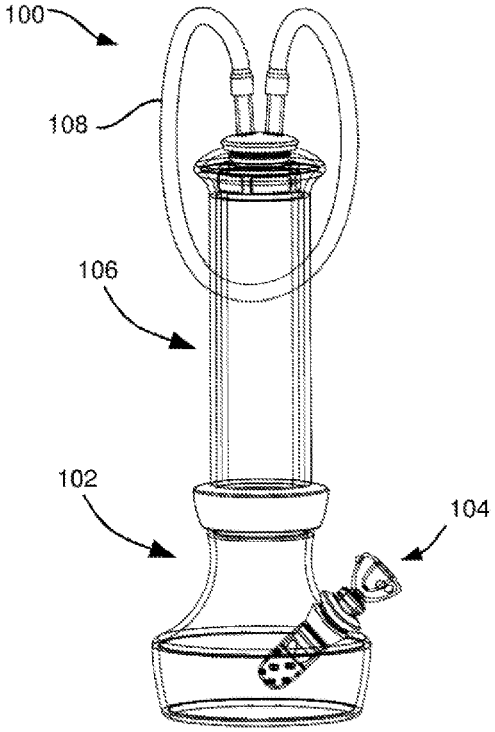
FIG. 2A is a perspective view of a smoking apparatus, configured at a retracted condition, according to one embodiment.
Figure 2B:
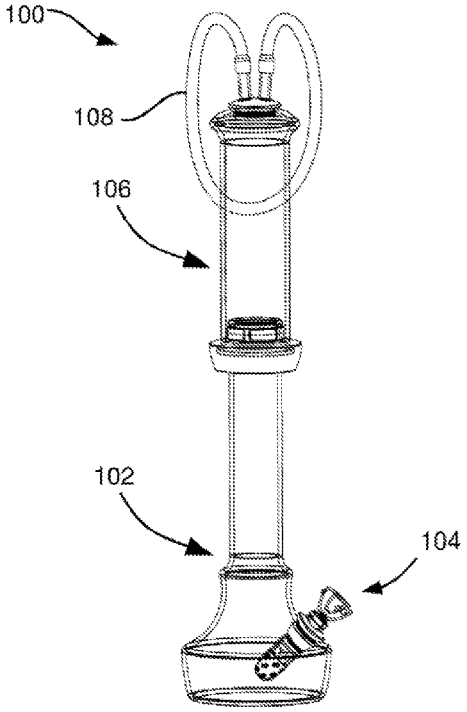
FIG. 2B is a perspective view of the smoking apparatus shown in FIG. 2A, configured at an expanded condition.

Turning now to FIGS. 2A and 2B, a smoking apparatus, also denoted as a bong or waterpipe, is shown and is generally identified using numeral 100. FIG. 2 shows the smoking apparatus 100 in an expanded configuration, and FIG. 3 shows the smoking apparatus 100 in a retracted configuration.

As shown, the smoking apparatus 100 comprises a vessel 102, a smoking generation structure 104 sealably coupled to the vessel 102 at a lower portion thereof, a sleeve or draw tube 106 sealably and slidably coupled to the vessel 102 at an upper portion thereof, and a flexible smoke guide 108 sealably couple to an upper, distal end of the sleeve 106.

Figure 3:
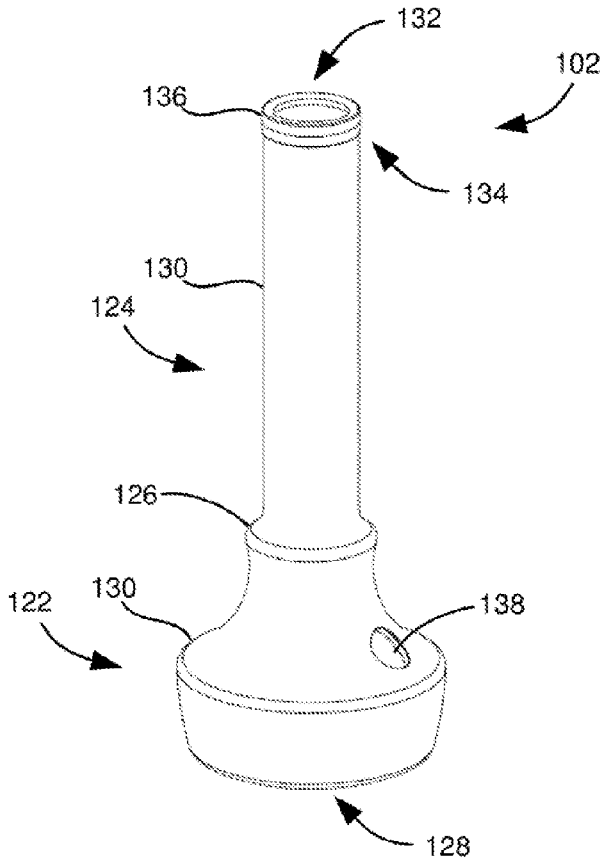
FIG. 3 is a perspective view of a vessel of the smoking apparatus shown in FIG. 2A.
Figure 4:
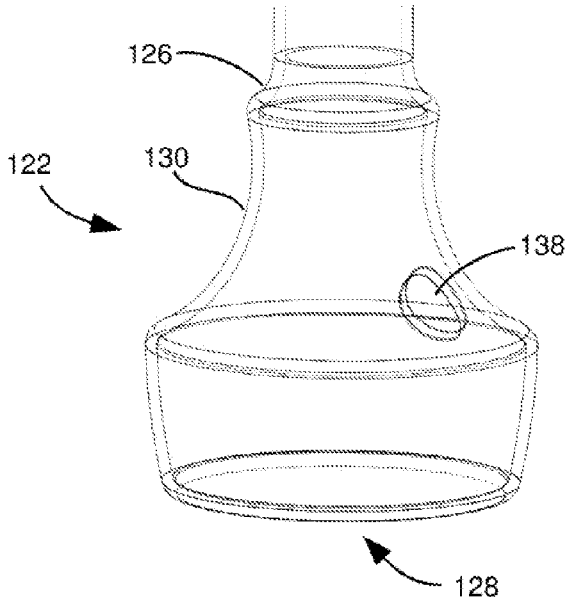
FIG. 4 is a perspective view of a base portion of the vessel shown in FIG. 3.

FIG. 3 is a perspective view of the vessel 102, and FIG. 4 is an enlarged perspective view of a lower portion thereof. As shown in FIG. 3, the vessel 102 in this embodiment is a glass vessel, and comprises a lower, kettle-like base portion 122, an upper, cylindrical neck portion 124, with a circumferential step 126 therebetween formed by a sidewall 130 of the vessel 102.

As shown in FIGS. 3 and 4, the base portion 122 comprises a circular bottom wall 128 of a first diameter. A cylindrical sidewall 130 extends upwardly and slightly outwardly from the circumference of the bottom wall 128 to a predefined height, and then tapers to the step 126 of a second diameter smaller than the first diameter. At the step 126, the sidewall 130 transits to a third diameter smaller than the second diameter, and then extends upwardly, forming the neck portion 124 with an upper opening 132 at an upper end 134 thereof.

A sleeve guide 136 is coupled to the outer surface of the neck portion 124 about its upper end 134. In this embodiment, the sleeve guide 136 is made of compression-molded silicone, preferably but not necessarily of a Shore durometer hardness of 80 A. The inner surface of the sleeve guide 136 is polished for reliably coupling to the neck portion 124, and the outer surface thereof is texturized to reduce the friction when the sleeve 106 is sliding thereabout.

The base portion 122 of the vessel 102 comprises a stem opening 138 on the sidewall 130, preferably at the tapering portion thereof, for receiving the smoke generation structure 104. In this embodiment, the edge of the stem opening 138 is polished for sealably fitting an inlet valve of the smoke generation structure 104 (described later).

Figure 5A:
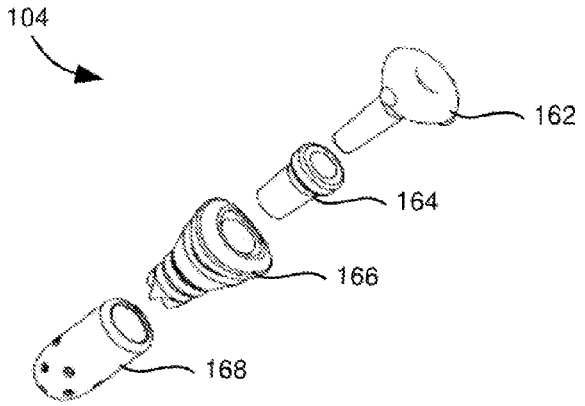
FIG. 5A is an exploded view of a smoke generation structure of the smoking apparatus shown in FIG. 2A.
Figure 5B:
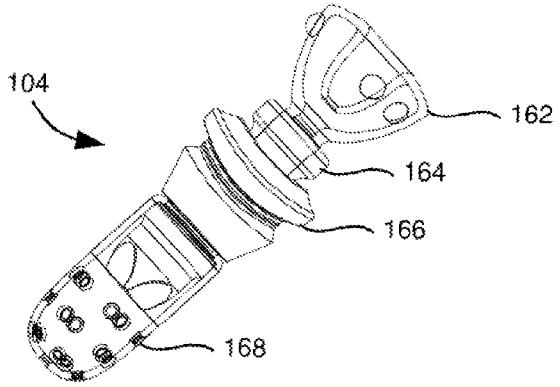
FIG. 5B is a side view of the smoke generation structure shown in FIG. 5A.

FIG. 5A is an exploded view of the smoke generation structure 104, showing the components thereof, and FIG. 5B is a side view of the assembled smoke generation structure 104. In FIG. 5B, the vessel is omitted for ease of illustration. As shown in FIGS. 5A and 5B, the smoke generation structure 104 in this embodiment comprises a bowl 162, a bowl adapter joint or guide 164, a pressure actuated inlet valve 166, and a percolator 168.

Figure 6:
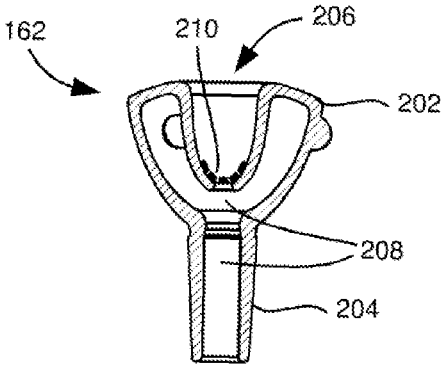
FIG. 6 is a cross-section view of a bowl of the smoke generation structure shown in FIG. 5A.

In this embodiment, the bowl 162 is made of glass. FIG. 6 is a cross-section view of the bowl 162. As shown, the bowl 162 comprises a bowl-shaped head portion 202 and a frustoconical tail portion 204 slightly tapering towards a distal end thereof. Of course, those skilled in the art appreciate that the tail portion 204 may alternatively have a generally cylindrical shape.

The head portion 202 of the bowl 162 comprises a recess 206 in fluid communication with a bore 208 of the tail portion 204. A screen 210 is coupled to the recess 206 over the bore 208 for preventing solids, such as the ash of burnt smoking herbal substance, from entering the bore 208.

Figure 7:
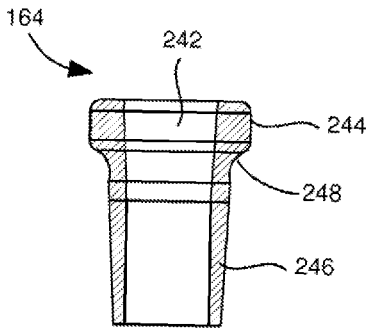
FIG. 7 is a cross-section view of a bowl adapter joint of the smoke generation structure shown in FIG. 5A.

In this embodiment, the bowl adapter joint 164 is made of glass. FIG. 7 is a cross-section view of the bowl adapter joint 164. As shown, the bowl adapter joint 164 is generally a cylindrical plug having a radially-expanded head portion 244 transiting to a body 246 slightly tapering towards a distal end thereof, and a bore 242 with an inner diameter suitable (for example, generally equal to the largest outer diameter of the tail portion 204 of the bowl 162) for sealably receiving therein the tail portion 204 of the bowl 162. The interface between the head portion 244 and the body 246 forms a downwardly facing shoulder 248.

In this embodiment, the inlet valve 166 is a one-way, cross-slit valve made of compression-molded silicone, preferably but not necessarily of a Shore durometer hardness of 30 A, and is also used for sealably coupling the smoke generation structure 104 to the vessel 102 through the stem opening 138. Those skilled in the art appreciate that the inlet valve 166 may be made of compression-molded silicone with other suitable hardness. For example, in an alternative embodiment, the inlet valve 166 is made of compression-molded silicone of a Shore durometer hardness of 40 A. In another embodiment, the inlet valve 166 is made of compression-molded silicone of a Shore durometer hardness of 50 A.

Figure 8A:
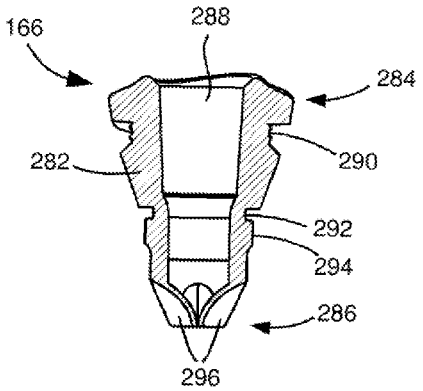
FIG. 8A is a cross-section view of an inlet valve of the smoke generation structure shown in FIG. 5A.
Figure 8B:
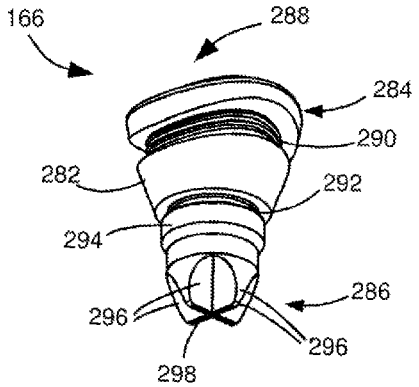
FIGS. 8B and 8C are side views of the inlet valve of the smoke generation structure shown in FIG. 5A.
Figure 8C:
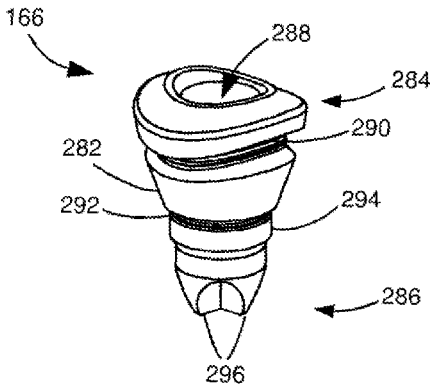

FIG. 8A is a cross-section view of the inlet valve 166, and FIGS. 8B and 8C are side views thereof from different viewing angles. As shown, the inlet valve 166 comprises a generally in a conical- or frustoconical-shaped sidewall 282, tapering from a first, open end 284 to a second, closable end 286. A bore 288 extends therebetween the first and second ends 284 and 286. The inner diameter of the bore 288 about the first end 284 is equal to or slightly smaller than the outer diameter of the body 246 of the bowl adapter joint 164.

The sidewall 282 of the inlet valve 166 comprises a first circumferential groove 290 on the outer surface thereof in proximity with the first end 284, for sealably adapting about the edge of the stem opening 138 of the vessel 102. The sidewall 282 also comprises a second circumferential groove 292 intermediate the first groove 290 and the second end 286 for coupling to the percolator 168. At least a portion 294 of the sidewall 282 intermediate the second groove 292 and the second end 286 has a suitable diameter for sealably fitting into a bore of the percolator 168.

The sidewall 282 about the second end 286 is configured to one or more flexible pieces 296 forming one or more openable slits acting as a one-way valve. For example, as shown in in FIGS. 8A to 8C, the sidewall 282 is configured to four flexible pieces 296 with two slits 298 arranged as a cross at the second end 286, forming a one-way valve. The flexible pieces 296 are pliable between an unbiased position and a biased position for closing and opening the one-way valve.

In particular, when at an unbiased position, or when the pressure applied to the flexible pieces 296 from an exterior side thereof (exterior pressure) is larger than that applied to the flexible pieces 296 from an interior side thereof through the bore 288 (interior pressure), the plurality of flexible pieces 296 are sealably in contact with each other, closing the cross-slits 298. The inlet valve 166 is then closed, preventing fluid, such as water, air, or smoke, to flow into the bore 288. On the other hand, when the exterior pressure is smaller than the interior pressure, the plurality of flexible pieces 296 are biased outwardly, opening the cross-slits 298. The inlet valve 166 is then open, allowing fluid, such as air or smoke, to flow out of the bore 288 through the cross-slits 298.

Figure 9:
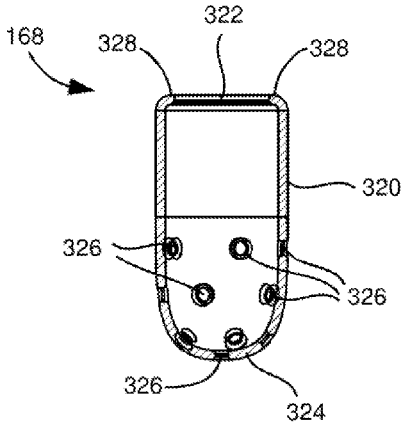
FIG. 9 is a cross-section view of a percolator of the smoke generation structure shown in FIG. 5A.

FIG. 9 is a cross-section view of the percolator 168. In this embodiment, the percolator 168 is generally a hollow, glass cylinder having an upper opening 322, a generally cylindrical sidewall 320, and a perforated bottom wall 324 having a plurality of holes 326. The sidewall 320 has an inner diameter equal to or slightly smaller than the outer diameter of the sidewall 282 of the inlet valve 166 about the first groove 290. Moreover, at the upper opening 322, the sidewall 320 extends inwardly forming a circumferential inner ridge 328 for engaging the second groove 292 of the inlet valve 166.

Figure 10A:
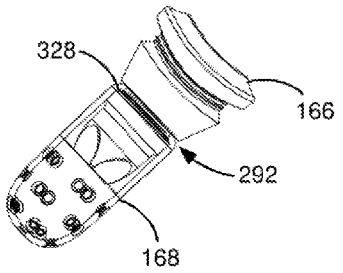
FIG. 10A is a side view of the inlet valve and the percolator assembled together.
Figure 10B:
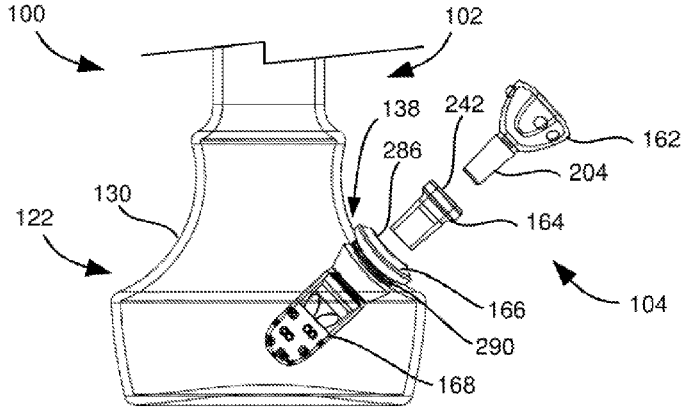
FIG. 10B is a side view of a lower portion of the smoking apparatus, illustrating the assembling and installation of the smoke generation structure to the vessel.
Figure 10C:
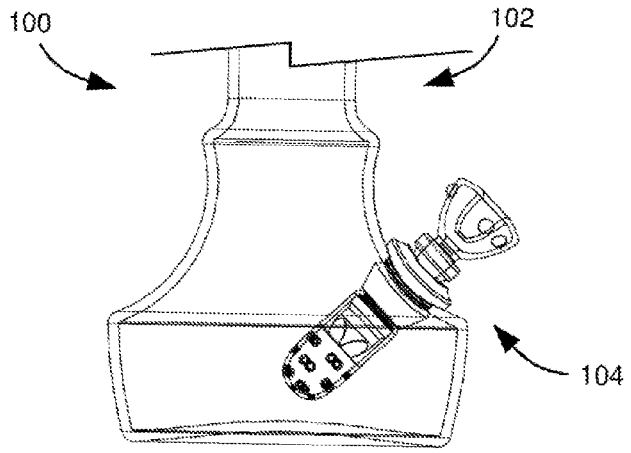
FIG. 10C shows a portion of the smoking apparatus with the smoke generation structure installed to the vessel.

With reference to FIGS. 10A to 10C, to assemble and install the smoke generation structure 104 to the vessel 102, one may first insert the second end 284 of the inlet valve 166 into the percolator 168 through the upper opening 322 thereof, such that the circumferential inner ridge 328 of the percolator 168 sealably engages the second groove 292 of the inlet valve 166 (FIG. 10A).

As shown in FIG. 10B, the assembled inlet valve 166 and percolator 168, as a whole, are then inserted through the stem opening 138 of the vessel 102 such that the first groove 290 of the inlet valve 166 sealably engages to the edge of the stem opening 138 of the vessel 102. The bowl adapter joint 164 is then sealably inserted into the bore 288 of the inlet valve 166, and the tail 204 of the bowl 162 is sealably inserted into the bore 242 of the bowl adapter joint 164. FIG. 10C shows a portion of the smoking apparatus 100 with the smoke generation structure 104 installed to the vessel 102.

Figure 11:
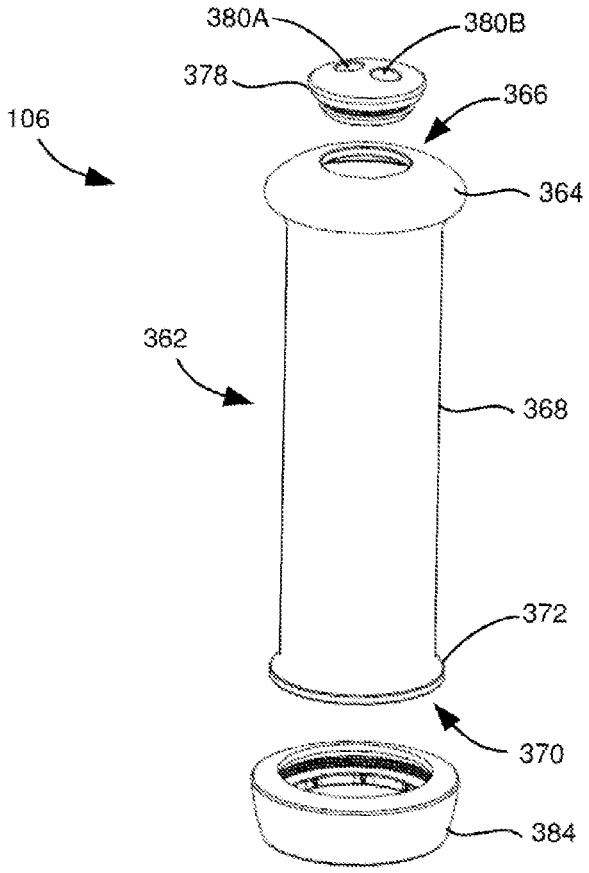
FIG. 11 is an exploded perspective view of a sleeve of the smoking apparatus shown in FIG. 2A.

FIG. 11 is an exploded perspective view of the sleeve 106. As shown, the sleeve 106 comprises a sleeve body 362 in the form of a glass, cylindrical tubing having a top wall 364 with a top opening 366 thereon, a sidewall 368, and an open bottom 370. The inner diameter of the body 362 is equal to or slightly larger than the outer diameter of the sleeve guide 136 of the vessel 102. Moreover, the sidewall 368 at a distal end of sleeve body 362 extends radially outwardly about the open bottom 370, forming a circumferential outer ridge 372.

A top stopper or cap 378 sealably fits into the top opening 366 of the sleeve body 362. The cap 378 in this embodiment is made of compression-molded silicone, preferably but not necessarily of a Shore durometer hardness of 50 A, and comprises two mouthpiece holes 380A and 380B for sealably receiving two mouthpieces of the flexible smoke guide 108, respectively.

In this embodiment, the sleeve 106 also comprises a draw seal 384 sealably fitting to the outer surface of the sleeve body 362 about the open bottom 370. The draw seal 384 in this embodiment is made of compression-molded silicone, preferably but not necessarily of a Shore durometer hardness of 50 A.

Figure 12:
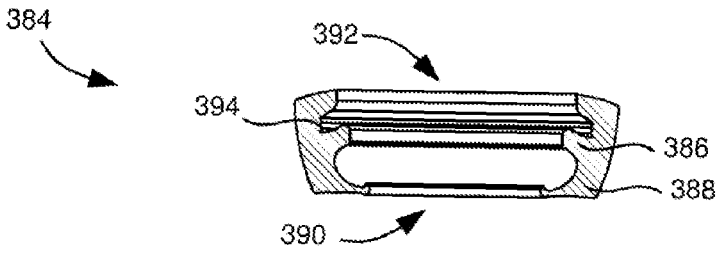
FIG. 12 is a cross-section view of a draw seal of the sleeve shown in FIG. 11.
Figure 13:
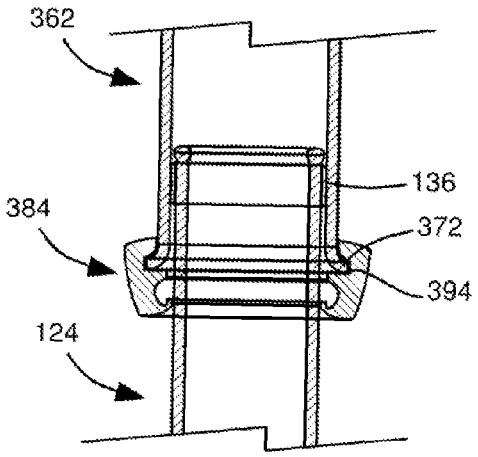
FIG. 13 is a cross-section view of a portion of the smoking apparatus showing the draw seal installed on the sleeve body and slidably engaging the neck portion of the vessel.

As shown in FIG. 12, the draw seal 384 is generally a cylindrical tube. A circumferential inner ridge 386 extends inwardly from the sidewall 388, partitioning the draw seal 384 into a vessel-adapting portion 390 for sealably receiving the neck 124 of the vessel 10, and a sleeve-adapting portion 392 for sealably receiving the sleeve body 362. The sleeve-adapting portion 392 comprises a circumferential inner groove 394 on the inner surface thereof for engaging the outer ridge 372 of the sleeve body 362. FIG. 13 shows the draw seal 384 installed on the sleeve body 362, and slidably engages the neck portion 124 of the vessel 102.

Figure 14:
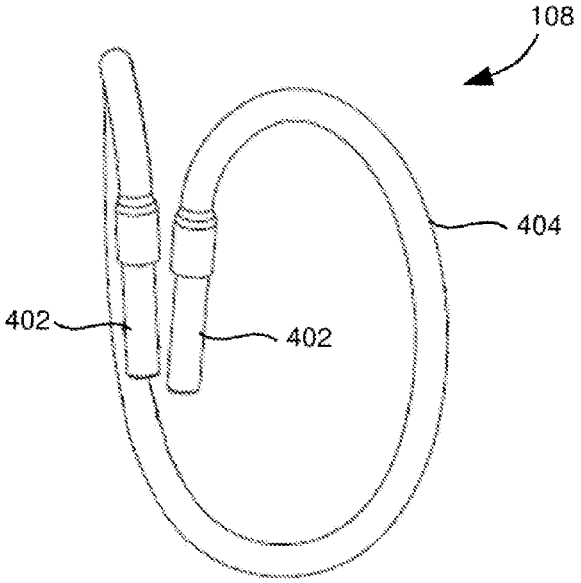
FIG. 14 is a perspective view of a flexible smoke guide of the smoking apparatus shown in FIG. 2A.
Figure 15:
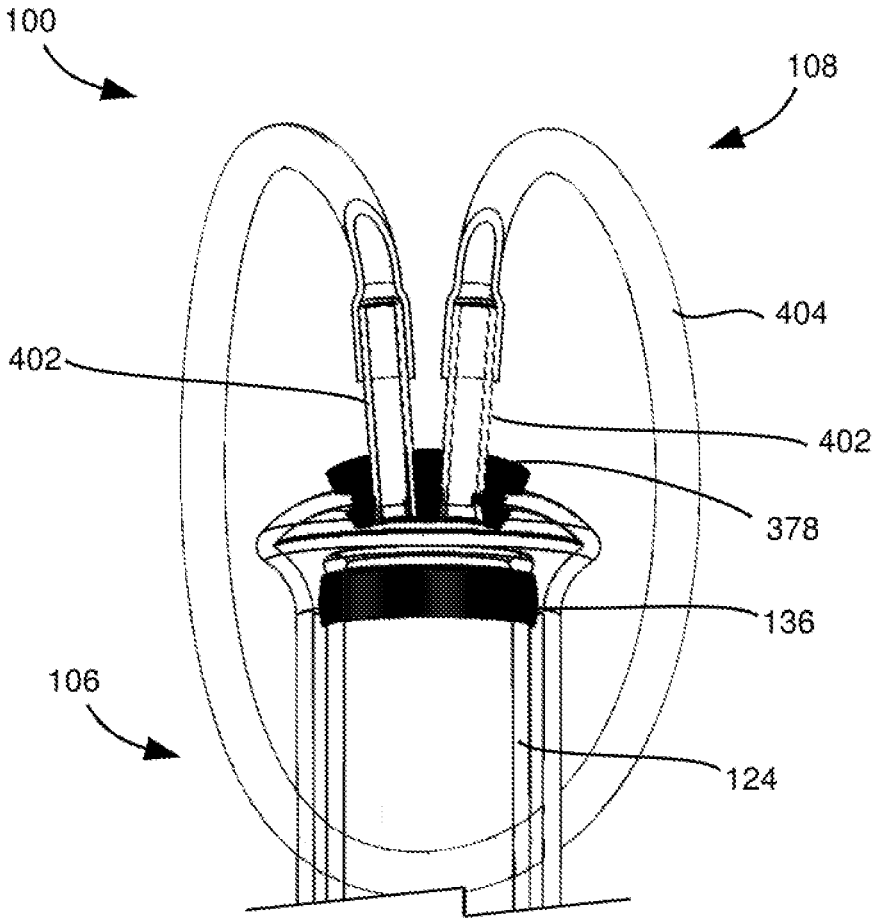
FIG. 15 is a partial cross-section view of an upper portion of the smoking apparatus shown in FIG. 2A, showing the connection between the flexible smoke guide (shown in FIG. 13) and the sleeve (shown in FIG. 12)

As shown in FIG. 14, the flexible smoke guide 108 comprises a flexible tube 404 with each end thereof sealably coupled to a mouthpieces 402. In this embodiment, each of the mouthpieces in this embodiment is a cylindrical, borosilicate glass tube. FIG. 15 is a partial cross-section view of an upper portion of the smoking apparatus 100, showing the connection between the flexible smoke guide 108 and the sleeve 106.

Figure 16:
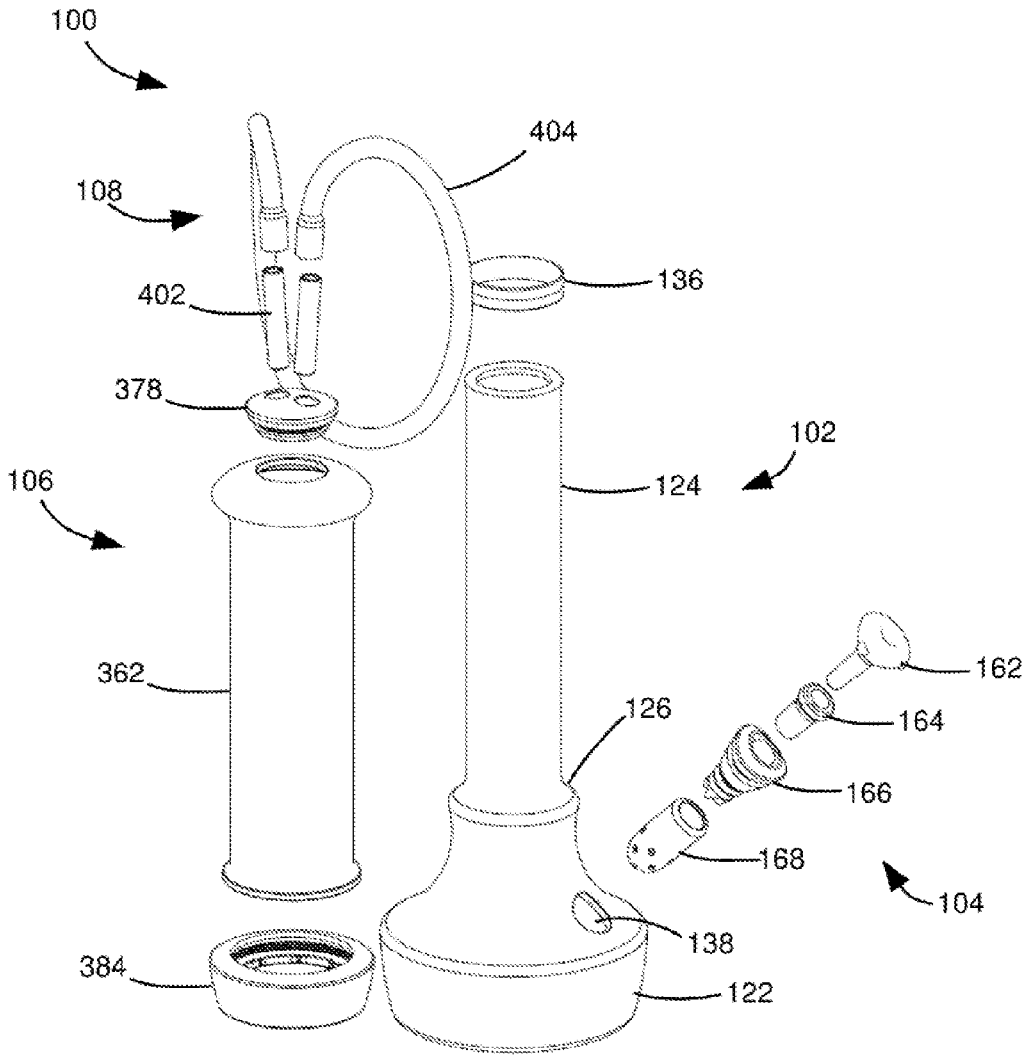
FIG. 16 is an exploded view of the smoking apparatus shown in FIG. 2A, showing the components thereof.

For better illustration, FIG. 16 is an exploded view of the smoking apparatus 100, showing the components thereof.

The assembled sleeve 106 may be attached to the vessel 102 by sliding the sleeve 106 onto the neck portion 124 thereof. The sleeve 106 may slide on the neck portion 124 between the shoulder 126 and the sleeve guide 136, acting as a pump. The smoking apparatus 100 may be configured to a retracted condition when the sleeve 106 slides down to about the step 126 and is configured to an expanded condition when the sleeve 106 slides up to about the sleeve guide 136.

Figure 17A:
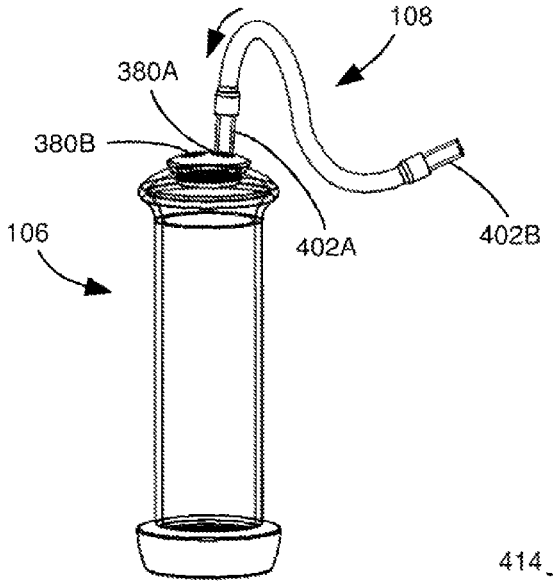
FIGS. 17A to 17G illustrate the operation of the smoking apparatus shown in FIG. 2A.

FIGS. 17A to 17F illustrate the use of the smoking apparatus 100. As shown in FIG. 17A, a user first removes the sleeve 106 from the vessel 102, sealably inserts a mouthpiece 402A of the flexible smoke guide 404 into a mouthpiece hole such as 380A, and leaves the other mouthpiece hole 380B open.

Figure 17B:
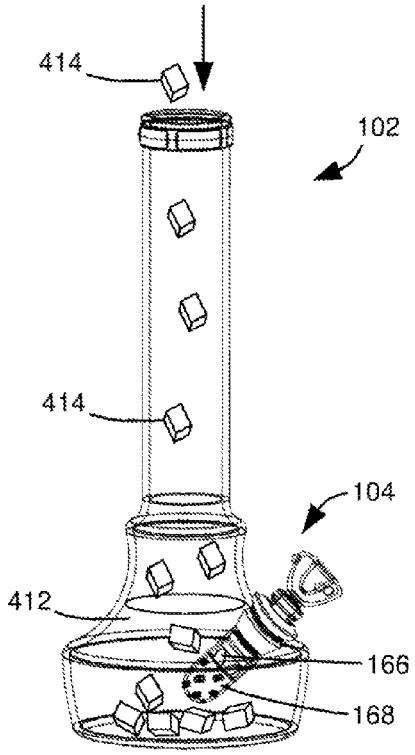

As shown in FIG. 17B, the user fills the vessel 102 with sufficient water 412 and ice 414 such that at least the percolator 168 is below the water surface. The inlet valve 166 is closed due to the exterior pressure applied by the water 412.

Figure 17C:
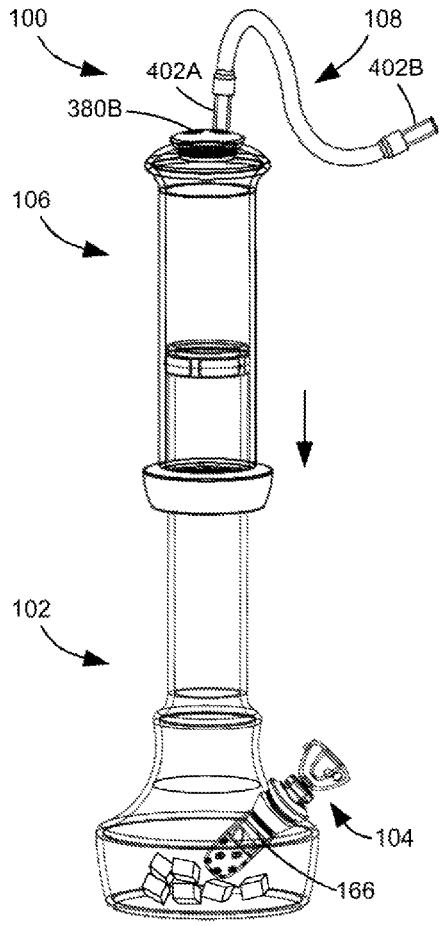

Then, as shown in FIG. 17C, the user slides the sleeve 106 onto the neck portion 124, and pushes down the sleeve 106 to configure the smoking apparatus to the retracted condition. While the sleeve 106 is pushed down, the inlet valve 166 is maintained closed, and air in the vessel 102 is released from the mouthpiece 402B and the mouthpiece hole 380B.

Figure 17D:
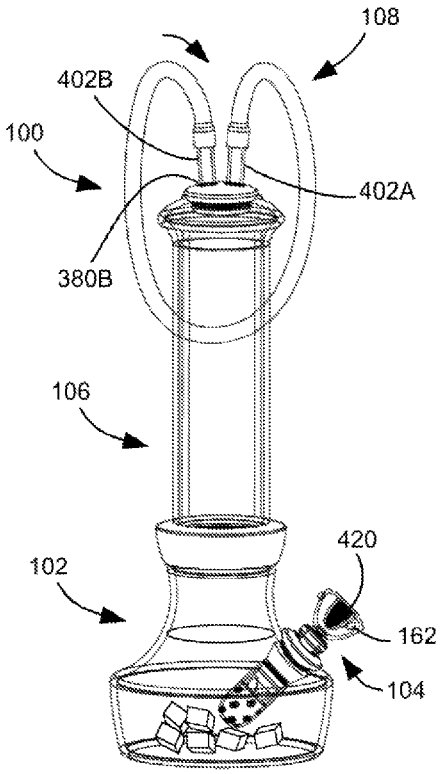

As shown in FIG. 17D, the user then sealably inserts the second mouthpiece 402B into the mouthpiece hole 380B to seal the top of the sleeve 106, and then fill combustible herbal substance 420 into the recess of the bowl 162.

Figure 17E:
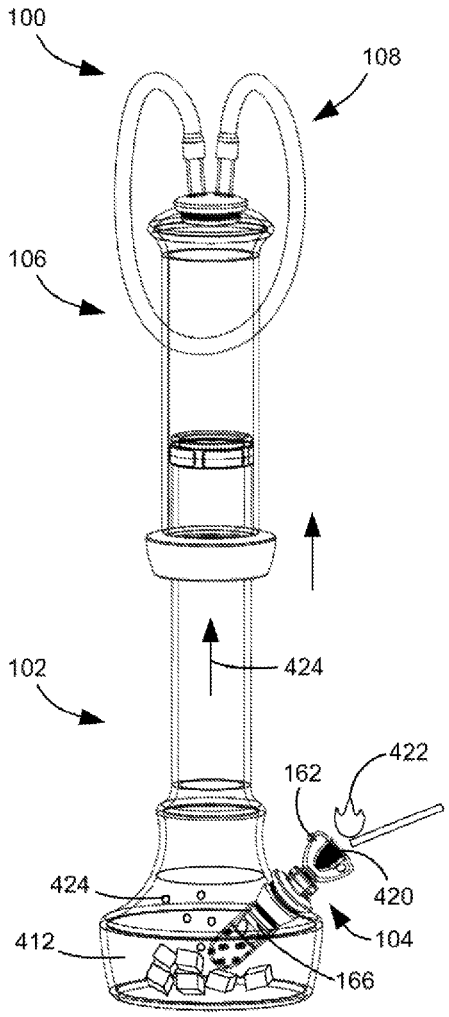

As shown in FIG. 17E, the user uses an external lighting device 422 to light the combustible herbal substance 420 in the bowl 162, and, while both mouthpieces 402A and 402B are sealably maintained in the mouthpiece holes 380A and 380B, respectively, the user slides the sleeve 106 upwardly to draw air into the vessel from the smoke generation structure 104. The exterior pressure about the inlet valve 166 is then reduced, causing the valve 166 to open. The inflow air flows through the burning smoking herbal substance 420, causing generation of smoke 424. The generated smoke 424 is guided through the smoke generation structure 104 through the opened valve 166, and is discharged into the ice water 412. After filtered and cooled by the ice water 412, the smoke 424 then escapes from the water and fills in the neck portion 124 and the interior space of the sleeve 106 above the neck portion 124.

Figure 17F:
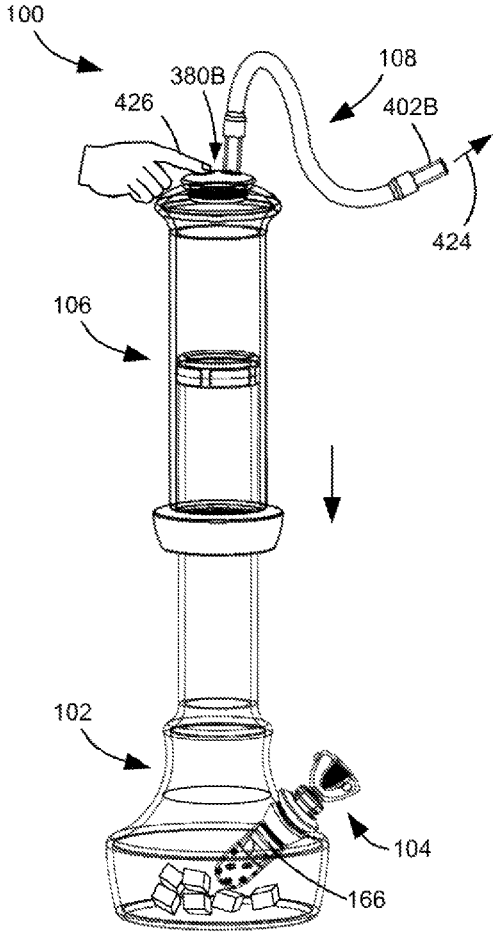

As shown in FIG. 17F, the user removes a mouthpiece, e.g., 402B, from the mouthpiece hole 380B, and put the mouthpiece 402B into his/her mouth (not shown). The user then uses a finger 426 or otherwise an insert to seal the mouthpiece hole 380B, and push the sleeve 106 down. The increased pressure in the vessel 102 closes the inlet valve 166, and forces the smoke to flow out of the mouthpiece 402B for the user to enjoy.

As shown in FIG. 17G, the user again inserts the mouthpiece 402B into the mouthpiece hole 380B, and pulls the sleeve 106 upward to draw air into the vessel from the smoke generation structure 104. As described above, the exterior pressure about the inlet valve 166 is then reduced, causing the valve 166 to open. The inflow air flows through the burning combustible herbal substance 420, causing generation of smoke 424. The generated smoke 424 is guided through the smoke generation structure 104 through the opened valve 166, and is discharged into the ice water 412. After filtered and cooled by the ice water 412, the smoke 424 then escapes from the water and fills in the neck portion 124 and the interior space of the sleeve 106 above the neck portion 124.

Then, the user follows the above step with regard to FIG. 17F to release the smoke from the apparatus 100 to enjoy.

Figure 17G:
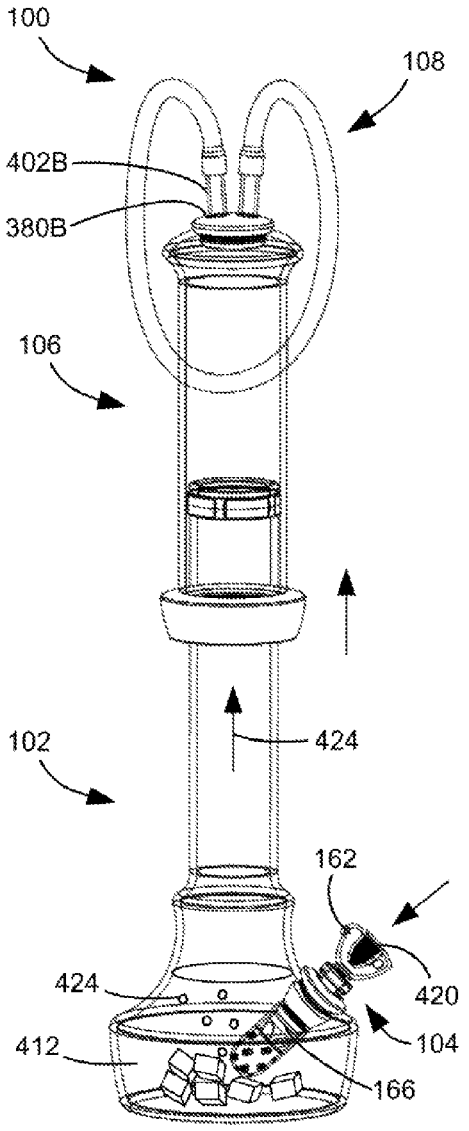

The user may repeat the steps with regard to FIGS. 17G and 17F to further enjoy the smoke.

Those skilled in the art appreciate that the vessel 102, the sleeve 106, the inlet valve 166, the flexible smoke guide 108 and the cap 378 form a pump transiting between a smoke-drawing state and a smoke-releasing state for pumping the smoke from a smoking source, e.g., the burning smoking herbal substance 420, to a smoke destination, e.g., a user's mouth. The flexible smoke guide 108 also act as a smoke outlet for discharging the smoke to the smoke destination. Therefore, the user can enjoy the smoke without sucking smoke from the smoking apparatus 100.

In particular, the sleeve 106 and the vessel 102 form a volume-changeable, smoke-accommodating chamber, the volume of which is enlarged in the smoke-drawing state and reduced in the smoke-releasing state. The flexible smoke guide 108 and the cap 378, particularly the mouthpiece 402B and the mouthpiece hole 380B, form an outlet valve that may be manually operated between a closed condition and an open condition. The outlet valve is closed by inserting the mouthpiece 402B into the mouthpiece hole 380B or by sealing the mouthpiece hole 380B using a finger 426 or otherwise an insert. The outlet valve is open by removing the mouthpiece 402B from the mouthpiece hole 380B or by removing the finger 426 or the insert from the mouthpiece hole 380B.

In the smoke-drawing state, the outlet valve is closed and the inlet valve is open. The sleeve 106 moves upward to enlarge the volume of the smoke-accommodating chamber and draw smoke thereinto. In the smoke-releasing state, the outlet valve is open and the inlet valve is closed. The sleeve 106 moves downward to reduce the volume of the smoke-accommodating chamber and release smoke from the flexible smoke guide 108. The smoking apparatus 100 repeatedly operates between the smoke-drawing state and the smoke-releasing state to repeatedly pump the smoke from the smoking source to the smoke destination.

Those skilled in the art appreciate that, various embodiments are readily available. For example, in some embodiments, the components of the smoking apparatus 100 may be made of other suitable material, e.g., steel, copper and the like, and the sealable components may be made of rubber.

Figure 18:
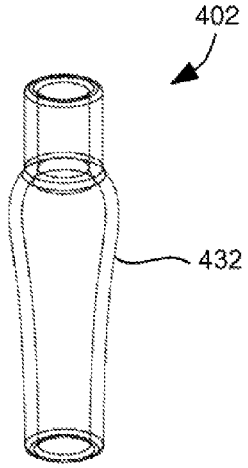
FIG. 18 is a perspective view of a mouthpiece of the flexible smoke guide, according to an alternative embodiment.

FIG. 18 shows a mouthpiece 402 of the flexible smoke guide 108, according to an alternative embodiment. As shown, the mouthpiece 402 is a glass tube having a blown body 432.

Figure 19:
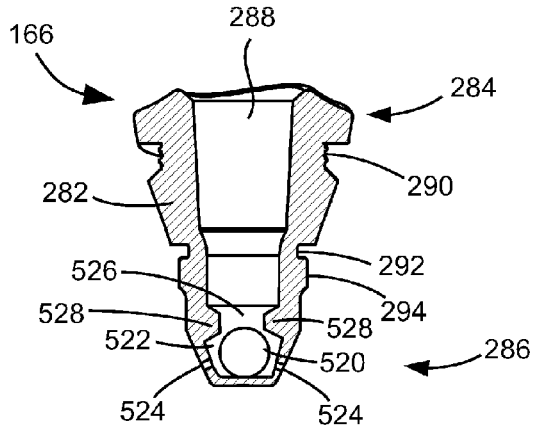
FIG. 19 is a cross-section view of the inlet valve in the form of a one-way, ball valve, according to an alternative embodiment.

Although in above embodiments, the inlet valve 166 is a pressure actuated, cross-slit, one-way valve, other one-way valves are also readily available. For example, FIG. 19 shows an inlet valve 166 in the form of a pressure actuated, one-way, ball valve, according to an alternative embodiment. The inlet valve 166 in this embodiment comprises a ball 520 movable in a ball chamber 522 about the second end 286. The ball chamber 522 comprises one or more openings 524 to the exterior of the inlet valve 166, and an access 526 on a ball seat 528 accessible to the bore 288. The ball 520 is movable in the ball chamber 522 between a closed position to block the access 526 when the exterior pressure is larger than the interior pressure in the bore 288, preventing fluid from entering the bore 288 from openings 524, and an open position to enable the access 526 when the exterior pressure is smaller than the interior pressure, allowing fluid to flow through the bore 288 and exit the openings 524.

Figure 20:
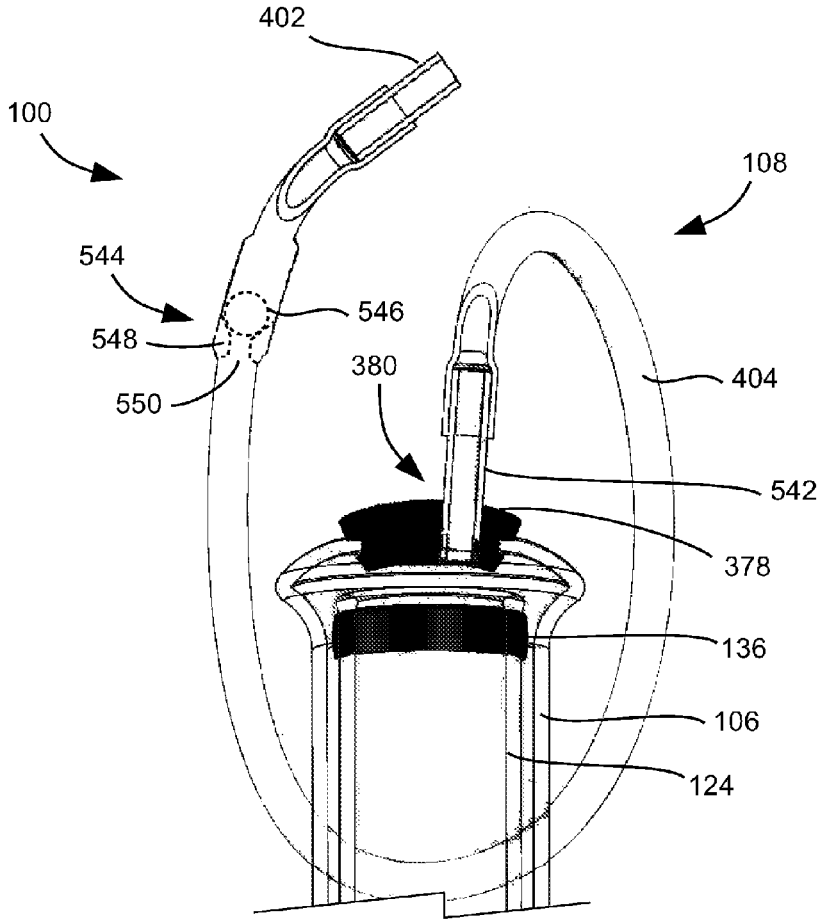
FIG. 20 is a partial cross-section view of an upper portion of a smoking apparatus, according to an alternative embodiment.

FIG. 20 shows a portion of a smoking apparatus 100 according to an alternative embodiment. The smoking apparatus 100 is similar to the smoking apparatus in previous embodiments with differences in the cap 378 and the flexible smoke guide 108.

As shown in FIG. 20, the cap 378 in this embodiment only comprises one the mouthpiece hole 380. Correspondingly, the smoke guide 108 comprises a mouthpiece 402, and a connection tubing 542 for sealably inserting into the mouthpiece hole 380. The flexible smoke guide 108 also comprises a pressure actuated, one-way outlet valve such as a ball valve 544 having a ball 546, and a ball seat 548 with an access 550, only allowing fluid to flow from the connection tubing 542 to the mouthpiece 402, and not allowing fluid to backflow along the opposite direction.

Therefore, in this embodiment, the user does not need to manually seal a mouthpiece hole in operation. Rather, when the user slides the sleeve 106 upwardly creating a lower pressure in the vessel 102, the ambient, atmosphere pressure forces the ball 546 to engage the ball seat 548 to block the access 550, preventing air flowing into the vessel 102 from the flexible smoke guide 108. When the user slides the sleeve 106 downwardly creating a pressure in the vessel 102 higher than the ambient, atmosphere pressure, the ball 546 is then forced to move away from and disengages the ball seat 548 to enable the access 550, allowing smoke to flow through the flexible smoke guide 108 and discharges from the mouthpiece 402.

In an alternative embodiment, the bowl comprises a lighting mechanism for lighting the smoking herb substance, without using an external lighting device.

Figure 21:
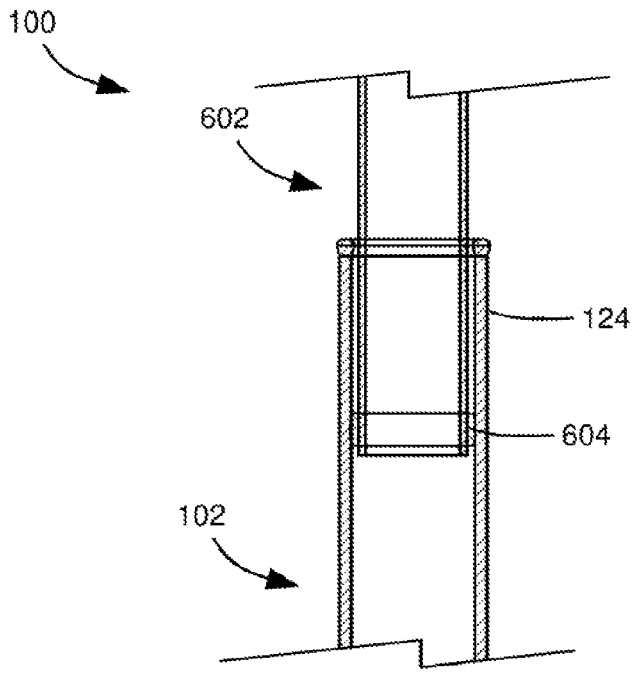
FIG. 21 is a partial cross-section view of a smoking apparatus having a hollow mandrel sealably and slidably received in a neck portion of a vessel, according to an alternative embodiment.

FIG. 21 shows a portion of a smoking apparatus 100, according to an alternative embodiment. The smoking apparatus 100 is similar to the smoking apparatus shown in FIGS. 2A and 2B. However, the smoking apparatus 100 in this embodiment does not comprise a sleeve. Rather, the smoking apparatus 100 comprises a hollow mandrel 602 in the form of a glass tube having a longitudinal bore. The mandrel 602 is slidably inserted into the neck portion 124 of the vessel 102. A seal 604 is attached to the mandrel 602 and slidably engages the neck portion 124. Similar to above embodiments, the mandrel 602 may slide up and down for drawing the smoke from the burning herb substance through the vessel 102 and discharging from the flexible smoke guide 108.

In an alternative embodiment, the smoke guide 108 is not flexible. For example, it may be a ridged smoke guide, either straight or curved towards a predetermined angle.

Although in above embodiments, water and ice are added to the vessel when use, in an alternative embodiment, only water is added to the vessel when use. In another embodiment, only ice is added to the vessel. In this embodiment, the generated smoke is cooled by the ice, but may not be filtered until the ice eventually melts to water. In yet another embodiment, the user may choose not to add any water or ice when use. In still another embodiment, the user may choose to add other filtering fluid into the vessel when use.

In an alternative embodiment, the smoke guide 108 comprises a first end permanently coupled to, or integrated with, the cap 370, and a second end coupled to a mouth piece. The cap 370 comprises a mouthpiece hole 372 for removably coupling to the mouthpiece 372.

Although in above embodiments, the sleeve 106 comprises a cap 370, in an alternative embodiment, the sleeve 106 does not comprise any cap. Rather, the sleeve 106 comprises a top wall having one or two mouthpiece holes 372 configured as described above.

Although in above embodiments, smoke is discharged from the top of the vessel 102. In some alternative embodiments, the smoke guide 108 may be coupled to and in fluid communication with the vessel 102 at the sidewall 130 thereof.

In some alternative embodiments similar to that shown in FIG. 21, instead of having a mandrel 602, the smoking apparatus 100 comprises a solid piston (also referenced using number 602) sealably and slidably received in the neck portion 124 of the vessel 102 for drawing smoke from the smoking source into the vessel and for pumping the smoke from the vessel to the smoke destination. In one embodiment, the piston 602 comprises two longitudinal bores for directing smoke from the vessel 102 to the smoke guide 108 (in a manner similar to FIG. 2A). In another embodiment, the piston 602 comprises a longitudinal bore with a one-way valve for directing smoke from the vessel 102 to the smoke guide 108 (in a manner similar to FIG. 20). In another embodiment, the piston 602 does not comprise any bore, and the smoke guide 108 is coupled to and in fluid communication with the vessel 102 on the sidewall 130 thereof.

Figure 22:
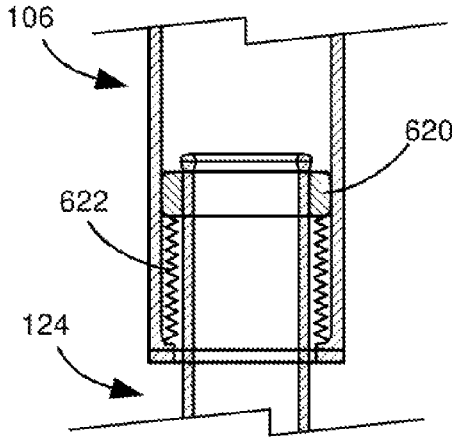
FIG. 22 is a partial cross-section view of a smoking apparatus having a biasing mechanism for configuring the smoking apparatus to an expanded condition, according to an alternative embodiment.

In above embodiments, the volume of the pump is changeable by manually sliding the sleeve 106 or mandrel 602 up and down. In an alternative embodiment as shown in FIG. 22, the neck portion 124 of the vessel 102 is slidably received in the sleeve 106. A seal 620 is coupled to the neck portion 124 of the vessel 102 about an upper end thereof, and seals the annulus between the sleeve 106 and the neck portion 124. A spring 622 is coupled to the seal 620 at a first end thereof, and coupled to the sleeve 106 at a second end thereof for biasing the sleeve 106 to configure the smoking apparatus 100 to an expanded condition. In operation, a user may apply a downward force to the sleeve 106 to overcome the bias of the spring 622 to manually slide the sleeve 106 downwardly to a retracted condition, reducing the volume of the pump and forcing the smoke being discharged from the smoke guide (not shown). Then, the user may release the downward force, and the spring 622 biases the sleeve 106 upwardly, increasing the volume of the pump and drawing the smoke into the vessel 102.

Similarly, in another embodiment, a spring may be used for biasing the sleeve 106 to configure the smoking apparatus 100 to a retracted condition. In operation, a user may manually apply an upward force to the sleeve 106 to overcome the bias of the spring to manually slide the sleeve 106 upwardly to an expanded condition, increasing the volume of the pump and drawing the smoke into the vessel 102. Then, the user may release the upward force, and the spring biases the sleeve 106 downwardly, reducing the volume of the pump and forcing the smoke being discharged from the smoke guide (not shown).

In some alternative embodiments, the base portion 122 of the vessel 102 does not have a kettle like shape. Rather, the base portion 122 of the vessel 102 may have any suitable shape. For example, in one embodiment, the base portion 122 of vessel 102 has a cylindrical shape. In another embodiment, the entire vessel 102 may be a cylindrical tube.

In an alternative embodiment, the neck portion 124 of the vessel 102 may have a cubical shape, i.e., having a rectangular cross section. Correspondingly, the sleeve 106 or the hollow mandrel 602 also has a cubical shape.

In above embodiments, the sleeve/mandrel and the neck portion of the vessel 102 form a manually operable pump. In some alternative embodiments, the vessel 102 does not form a part of the pump. In these embodiments, the vessel does not comprise a sleeve or a mandrel. Rather, a manually operable pump is attached to the vessel 102 and in fluid communication therewith for drawing smoke from the smoking source into the vessel and for pumping the smoke from the vessel to the smoke destination.

In some alternative embodiments, other suitable types of pumps may be used. For example, an automatic pump driven by a servo or an electrical motor may be used for drawing smoke from the smoking source into the vessel and for pumping the smoke from the vessel to the smoke destination. In one embodiment, the automatic pump is coupled to the vessel 102. In another embodiment, the automatic pump may be coupled to the smoke generation structure 104.

In some embodiments, the automatic pump alternately operates and stops with a predefined or user-adjustable frequency such that the smoke is discharged from the smoke guide for the user to consume in an intermittent manner adapting to the smoking pattern of the user.

Although embodiments have been described above with reference to the accompanying drawings, those of skill in the art will appreciate that variations and modifications may be made without departing from the scope thereof as defined by the appended claims.

What is claimed is:

1. A smoking apparatus comprising:

a vessel;

a smoke generation structure for accommodating a smoke-generation substance for generating smoke therefrom, the smoke generation structure coupled to a lower portion of the vessel and in fluid communication with the vessel through an inlet valve for guiding the smoke into the vessel;

a sleeve slidably receiving therein at least a portion of the vessel; and a smoke guide sealably coupled to the sleeve and in fluid communication with the sleeve and the vessel through an outlet valve for discharging the smoke out of the vessel;

wherein the sleeve and the vessel together form a volume-changeable pump for pumping the smoke from the smoking generation structure into the vessel through the inlet valve and for pumping the smoke out of the vessel through the outlet valve and the smoke guide.

2. The smoking apparatus of claim 1, wherein the smoke generation structure comprises a recess for accommodating the smoke-generation substance.

3. The smoking apparatus of claim 2, wherein the smoke generation structure comprises the inlet valve, and wherein the inlet valve is a pressure-actuatable one-way valve for only allowing fluid communication from the recess to the vessel.

4. The smoking apparatus of claim 3, wherein the inlet valve comprises one or more flexible pieces forming one or more slits, the slits openable under a positive pressure applied to the one or more flexible pieces from an inflow direction, and closable under a positive pressure applied to the one or more flexible pieces from a backflow direction opposite to the inflow direction.

5. The smoking apparatus of claim 1, wherein the sleeve comprises the outlet valve, and wherein the outlet valve is a one-way valve for only allowing the smoke being discharged from the vessel via the smoke guide.

6. The smoking apparatus of claim 5, wherein the sleeve comprises a top wall, and wherein the top wall comprises a first opening sealably receiving a first end of the smoke guide, and a second opening removably and sealably receiving a second end of the smoke guide, the top wall of the sleeve and the smoke guide forming the outlet valve.

7. The smoking apparatus of claim 6, wherein the top wall comprises a removable cap; and wherein the cap comprises the first opening and the second opening.

8. The smoking apparatus of claim 1, wherein the smoke guide comprises the outlet valve, and wherein the outlet valve is a pressure-actuatable one-way valve for only allowing the smoke being discharged from the vessel via the smoke guide.

9. A smoking method comprising:

filling water in a lower portion of a vessel;

generating smoke from a smoke-generation substance and guiding the generated smoke into the water via a smoke generation structure;

pumping by a pump, the smoke from the smoke generation structure into the vessel through a pressure-actuatable inlet valve; and pumping by the pump, the smoke accumulated in the vessel out of the vessel through a pressure-actuatable outlet valve and a smoke outlet;

wherein said pumping the smoke from the smoke generation structure into the vessel comprises closing the outlet valve, and increasing the volume of a chamber of the pump for opening the inlet valve and drawing the smoke into the vessel; and wherein said pumping the smoke accumulated in the vessel out of the vessel comprises opening the outlet valve, and reducing the volume of the chamber for closing the inlet valve and discharging the smoke out of the vessel through the outlet valve and the smoke outlet.

10. The method of claim 9 wherein the chamber comprises the vessel and a sleeve; wherein the sleeve sealably and slidably receives therein at least a portion of the vessel; and wherein said increasing the volume of the chamber for opening the inlet valve and drawing the smoke into the vessel comprises:

sliding the sleeve along a first direction to increase the volume of the chamber for opening the inlet valve and drawing the smoke into the vessel.

11. The method of claim 10 wherein said reducing the volume of the chamber for closing the inlet valve and discharging the smoke out of the vessel comprises:

sliding the sleeve along a second direction opposite to the first direction to reduce the volume of the chamber for closing the inlet valve and discharging the smoke out of the vessel through the outlet valve and the smoke outlet.

12. The method of claim 11 wherein the smoke outlet is a smoke guide, wherein the sleeve comprises a top wall, wherein the top wall comprises a first opening sealably receiving a first end of the smoke guide, and a second opening removably and sealably receiving a second end of the smoke guide, and wherein said closing the outlet valve comprises:

inserting the second end of the smoke guide into the second opening.

13. The method of claim 12 wherein said opening the outlet valve comprises:

removing the second end of the smoke guide from the second opening.

14. The method of claim 11 wherein the outlet valve is a pressure-actuatable one-way valve, wherein said sliding the sleeve along the first direction to increase the volume of the chamber also closes the outlet valve, and wherein said sliding the sleeve along the second direction to reduce the volume of the chamber also opens the outlet valve.

15. The method of claim 9 further comprising:

filling ice in the lower portion of the vessel.

16. The method of claim 9 wherein said filling water in the lower portion of the vessel comprises:

filling ice in the lower portion of the vessel, the ice meltable into water by the smoke pumped into the vessel.

17. The method of claim 9 wherein the chamber comprises the vessel and a hollow mandrel; wherein at least a portion of the mandrel is sealably and slidably received in the vessel; and wherein said increasing the volume of the chamber for opening the inlet valve and drawing the smoke into the vessel comprises: sliding the mandrel along a first direction to increase the volume of the chamber for opening the inlet valve and drawing the smoke into the vessel.

18. The method of claim 17 wherein said reducing the volume of the chamber for closing the inlet valve and discharging the smoke out of the vessel comprises: sliding the mandrel along a second direction opposite to the first direction to reduce the volume of the chamber for closing the inlet valve and discharging the smoke out of the vessel through the outlet valve and the smoke outlet.

19. A smoking apparatus comprising:

a vessel comprising a cylindrical upper portion;

a smoke generation structure for accommodating a smoke-generation substance for generating smoke therefrom, the smoke generation structure coupled to a lower portion of the vessel and in fluid communication with the vessel via an inlet valve for guiding the smoke into the vessel;

a hollow mandrel having a longitudinal bore, at least a portion of the mandrel slidably received in the upper portion of the vessel; and a smoke guide sealably coupled to the mandrel and in fluid communication with the mandrel and the vessel via an outlet valve for discharging the smoke out of the vessel;

wherein the mandrel and the vessel together form a volume-changeable pump for pumping the smoke from the smoking generation structure into the vessel through the inlet valve and for pumping the smoke out of the vessel through the outlet valve and the smoke guide.

20. The smoking apparatus of claim 19, wherein the smoke generation structure comprises a recess for accommodating the smoke-generation substance; wherein the inlet valve is a pressure-actuatable one-way valve for only allowing fluid communication from the recess to the vessel; and wherein the outlet valve is a one-way valve for only allowing the smoke being discharged from the vessel via the smoke guide.

* * * * *